US010214046B2

(12) United States Patent
Yoon

(10) Patent No.: US 10,214,046 B2
(45) Date of Patent: Feb. 26, 2019

(54) WRITING INSTRUMENT HAVING AUTOMATIC SEALING STRUCTURE

(71) Applicant: MORRIS CORPORATION, Inchon-si (KR)

(72) Inventor: Hyun-son Yoon, Gyeonggi-do (KR)

(73) Assignee: MORRIS CORPORATION, Inchon-si (KR)

( * ) Notice: Subject to any disclaimer, the term of this patent is extended or adjusted under 35 U.S.C. 154(b) by 79 days.

(21) Appl. No.: 15/430,377

(22) Filed: Feb. 10, 2017

(65) Prior Publication Data

US 2018/0229539 A1 Aug. 16, 2018

(51) Int. Cl.
*B43K 24/00* (2006.01)

(52) U.S. Cl.
CPC ..... *B43K 24/00* (2013.01)

(58) Field of Classification Search
CPC ..... B43K 5/17; B43K 23/12; B43K 23/128; B43K 24/02; B43K 24/08
See application file for complete search history.

(56) References Cited

U.S. PATENT DOCUMENTS 2,362,948 A * 11/1944 Teague ..... B43K 5/17 401/106
6,866,436 B2 * 3/2005 Kanari ..... B43K 5/17 401/108
7,331,730 B2 * 2/2008 Fukui ..... B43K 5/17 401/108
7,931,416 B2 * 4/2011 Yoon ..... B43K 5/17 401/107
8,087,840 B2 * 1/2012 Yoon ..... B43K 8/003 401/108
8,177,447 B2 * 5/2012 Yoon ..... B43K 5/17 401/107
8,221,012 B2 * 7/2012 Rennecker ..... B43K 5/16 401/107

(Continued)

FOREIGN PATENT DOCUMENTS

KR 10-0817202 B1 3/2008

*Primary Examiner* — Jennifer C Chiang
*Assistant Examiner* — Bradley Oliver
(74) *Attorney, Agent, or Firm* — Intellectual Property Law Group LLP

(57) ABSTRACT

A writing instrument having an automatic sealing structure that may reduce an entire diameter of the writing instrument due to a decrease in a size of a ball shutter, thus to improve grip feeling of a user. The writing instrument having an automatic sealing structure includes: a body case having a front opening formed in one end thereof; a knock part coupled to the other end of the body case so as to make a nib protrude from or be retracted into the front opening of the body case by a pushing operation thereof; a cartridge inserted into the body case together with a spring in a state in which the knock part and the nib are coupled to both ends thereof, respectively; at least one O-ring fixedly fitted in the body case; a holder fixedly fitted in the body case so that one end thereof is covered by the O-ring; a ball shutter pivotally coupled to the holder to allow the nib to protrude or be sealed according to the pivoting thereof; and a link which is slidably fitted in the holder, and has a cutaway piece formed by protruding a circumferential portion of a part of a hollow column end thereof to allow the ball shutter to be pivoted.

5 Claims, 8 Drawing Sheets

(56) References Cited

U.S. PATENT DOCUMENTS

| | | | | |
|---|---|---|---|---|
| 8,393,814 | B2 * | 3/2013 | Challman | B43K 8/028 401/108 |
| 9,340,060 | B2 * | 5/2016 | Cheon | B43K 8/03 |
| 2007/0274764 | A1 * | 11/2007 | Shim | A45D 34/04 401/108 |
| 2008/0138139 | A1 * | 6/2008 | Kageyama | B43K 5/17 401/108 |
| 2010/0322697 | A1 * | 12/2010 | Rolion | B43K 8/028 401/107 |
| 2011/0103875 | A1 * | 5/2011 | Huang | B43K 8/00 401/104 |
| 2018/0056706 | A1 * | 3/2018 | Ballot | A46B 11/001 |

* cited by examiner

Prior Art

Prior Art

WRITING INSTRUMENT HAVING AUTOMATIC SEALING STRUCTURE

BACKGROUND OF THE INVENTION

1. Field of the Invention

The present invention relates to a writing instrument having an automatic sealing structure, and more particularly, to a writing instrument such as a ballpoint pen, highlighter, roller pen, board marker pen, oil-based marker pen, magic pen, plastic pen, or marking pen, which has an automatic sealing structure that allows a retractable type nib to protrude from a front opening of the writing instrument only when using the writing instrument, and the nib to be sealed in the writing instrument when not in use.

2. Description of the Related Art

A capless writing instrument having writing members, in which an ink thereof should not dry out, may be largely classified into two types. In a first group, by improving an ink or air hole of the writing member, the writing member is made the ink thereof difficult to dry out. In another second group, the writing implement is provided with a drying prevention unit in a body thereof.

For instance, the writing instrument of the first group includes a marking pen using a so-called "non-drying ink," and a ball-point pen which uses a water-based ink which is hard to dry out and has a very small air hole at a rear end portion of the writing member. Such a writing instrument of the first group is not provided with the drying prevention unit, such that there is an inconvenience in use of the writing instrument when it is not used for a long time.

In addition, the drying prevention unit provided in the second group is intended to prevent the ink from drying out by covering a front end of the writing implement with a cap while not in use. However, a writing instrument with a cap is inconvenient to use, and the cap may be easily lost.

Thereby, as a prior art to solve the above-described problems, there is a "retractable type writing instrument having a drying prevention unit" as disclosed in Korean Patent Registration No. 10-0817202 (published on Mar. 23, 2008), which has been filed and registered by the present applicant.

The "retractable type writing instrument having a drying prevention unit" is a retractable type writing instrument provided with a drying prevention unit for preventing a nib 41 from becoming dry out, and includes: as illustrated in FIG. 1, a knock part 30 coupled to a shaft 10 having a front opening 11 formed in one end thereof so as to make the nib 41 protrude therefrom or be retracted therein; a cartridge 40 inserted into the shaft 10 in a state in which the knock part 30 and the nib 41 are coupled to both ends thereof; a spring 50 installed within the shaft 10 so as to allow the cartridge 40 to return to its original position by an elastic restoring force thereof; an O-ring 60 supported by the spring 50 and fixedly fitted in the shaft 10; a holder 70 fixedly fitted in the shaft so that one end thereof is covered by the O-ring 60; a link 80 which is slidably fitted in the holder 70 and has a plurality of elastic lugs 85 formed at one end thereof, which move up and down along the holder 70 within a predetermined movement range, wherein the elastic lug 85 is locked to a step 48 of the cartridge 40 by a locking part formed at an end thereof; and a ball type door 90 connected to the link 80 by inserting a parallel pin 82 formed at the other end thereof into a pin slit 92 formed therein. When the cartridge

40 and the link 80 are moved forward from the fixed O-ring 60 and the holder 70 by pushing the knock part 30, the parallel pin 82 moves the pin slits 92 of the ball type door 90, and thereby the ball type door 90 is rotated about a pivot shaft 93 which is supported by spherical parts 70*a* to open the inside of the shaft. In this state, the nib 11 protrudes from the front opening of the shaft.

Herein, as illustrated in FIG. 2, during the ball type door 90 is rotated to open the inside of the shaft by a forward movement of the link 80, the front end portion of the link 80 is positioned on an inner surface of the rotated ball type door 90 with being moved forward.

Accordingly, since the link 80 is positioned on the inner surface of the rotated ball type door 90, a size of the ball type door 90 should be determined depending on a diameter of the link 80. That is, since the ball type door 90 has to contain the link 80 therein, the size thereof should be larger than the diameter of the link 80. As a result, the diameters of the other parts are also increased, and finally the entire diameter of the shaft 10 is increased. Therefore, there are disadvantages of increasing a weight thereof and worsening a grip feeling of the writing instrument.

SUMMARY OF THE INVENTION

In consideration of the above-mentioned circumstances, it is an object of the present invention to provide a writing instrument having an automatic sealing structure that may reduce an entire diameter of the writing instrument due to a decrease in a size of a ball shutter, thus to improve a grip feeling of a user.

In order to accomplish the above object, according to the present invention, there is provided a writing instrument having an automatic sealing structure, including: a body case having a front opening formed in one end thereof; a knock part coupled to the other end of the body case so as to make a nib protrude from or be retracted into the front opening of the body case by a pushing operation thereof; a cartridge inserted into the body case together with a spring in a state in which the knock part and the nib are coupled to both ends thereof, respectively; at least one O-ring fixedly fitted in the body case; a holder fixedly fitted in the body case so that one end thereof is covered by the O-ring; a ball shutter pivotally coupled to the holder to allow the nib to protrude or be sealed according to the pivoting thereof; and a link which is slidably fitted in the holder, and has a cutaway piece formed by protruding a circumferential portion of a part of a hollow column end thereof to allow the ball shutter to be pivoted.

Preferably, the link includes: a pair of elastic lugs formed to face each other at the hollow column end side facing the holder; cutaway faces formed on both sides of the cutaway piece in a longitudinal direction thereof; and a cutaway jaw formed along a circumferential surface thereof on the other side of the column orthogonal to the cutaway faces to limit the pivoting of the ball shutter.

In addition, the cutaway piece may be formed so as to have a circumferential length equal to or smaller than an inner circumferential length of the ball shutter.

Further, the cutting jaw may have a circumferential diameter of the same as an outer circumferential diameter of the ball shutter.

In accordance with the writing instrument having an automatic sealing structure according to the present invention, it is possible to achieve miniaturization in which an entire diameter of the writing instrument may be reduced due to a decrease in a size of the ball shutter, thus to improve a grip feeling of a user.

In addition, according to the present invention, since the diameter of the body case of the writing instrument is significantly reduced due to a decrease in the size of the ball shutter, an amount of air inflowing each time of opening and closing the ball shutter may be relatively reduced, and consequently, more effectively preventing ink from drying out.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF SPECIFIC EMBODIMENTS

Hereinafter, a writing instrument having an automatic sealing structure according to the present invention will be described in detail with reference to the attached drawings in terms of configuration and operation thereof.

Figure 1:
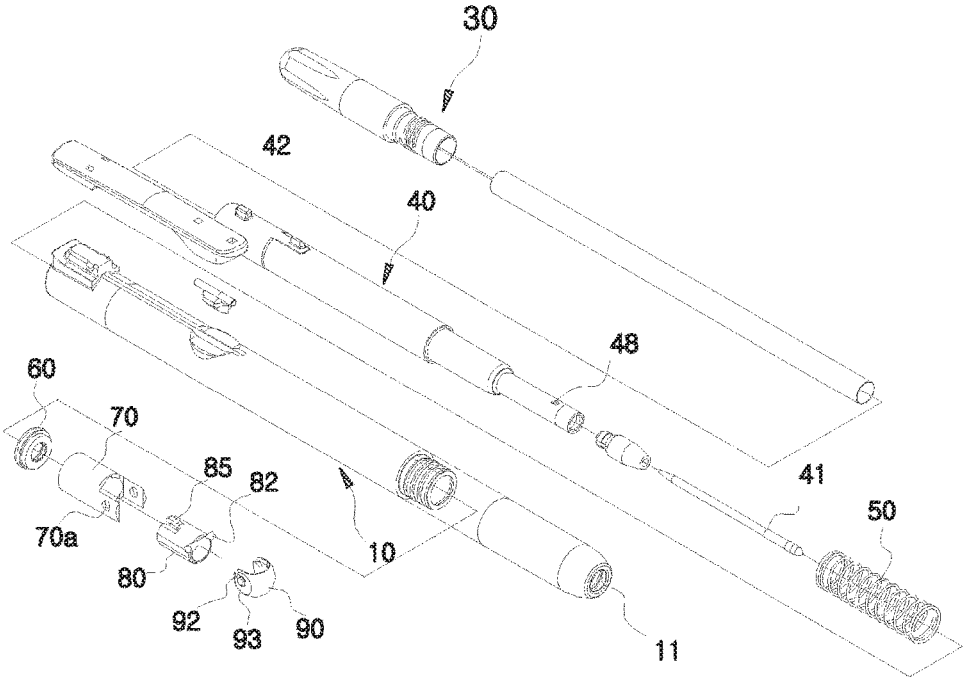
FIG. 1 is a perspective view illustrating a conventional retractable type writing instrument having a drying prevention unit.
Figure 2:
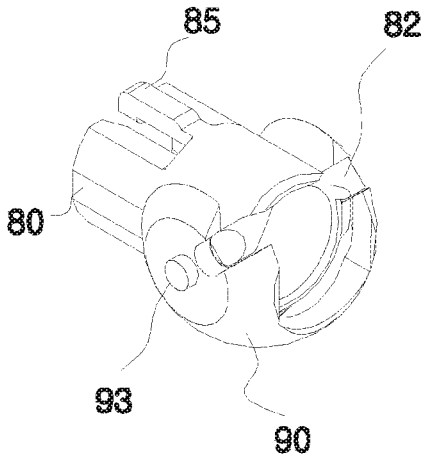
FIG. 2 is a perspective view illustrating an operational state of a ball type door and a link of the conventional writing instrument.
Figure 3:
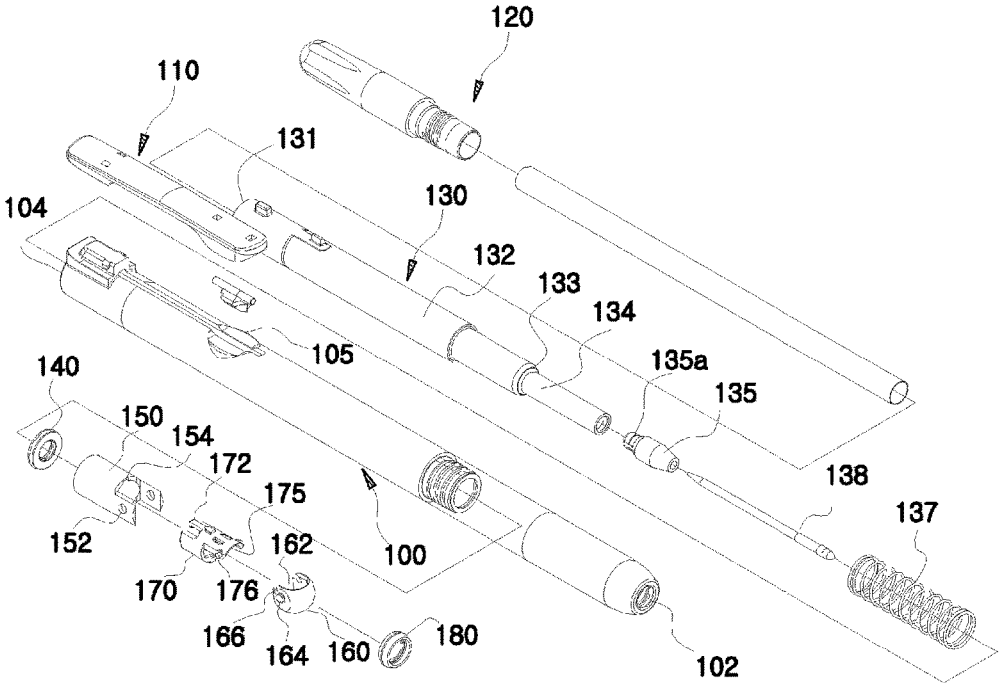
FIG. 3 is a perspective view illustrating a writing instrument having an automatic sealing structure according to the present invention.
Figure 4A:
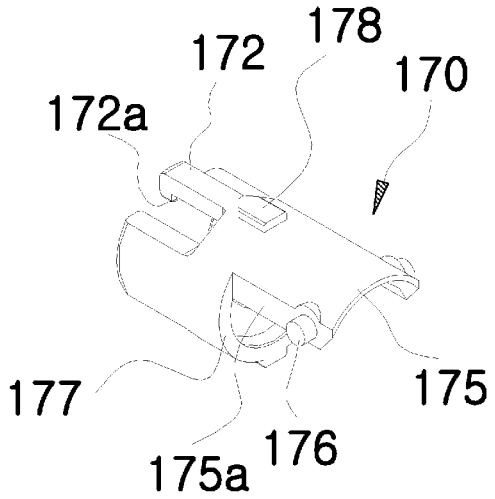
FIGS. 4A and 4B are perspective views illustrating a link of the writing instrument according to the present invention.
Figure 4B:
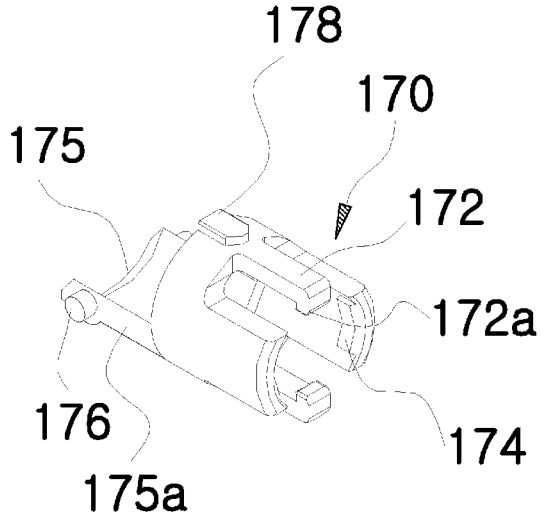
Figure 5A:
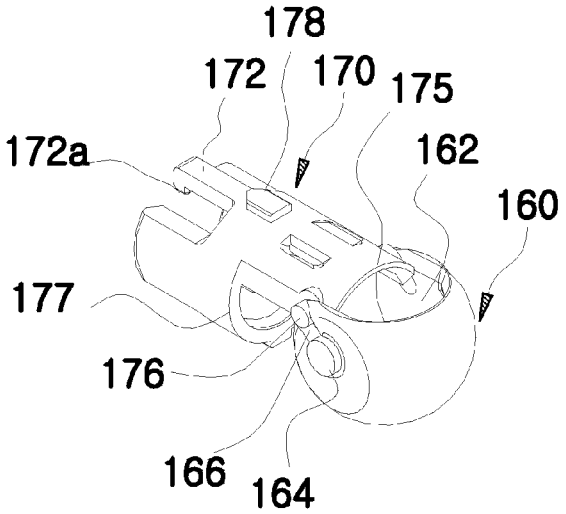
FIGS. 5A and 5B are a perspective view and a side view illustrating a state in which a ball shutter and the link are closed in the writing instrument according to the present invention.
Figure 5B:
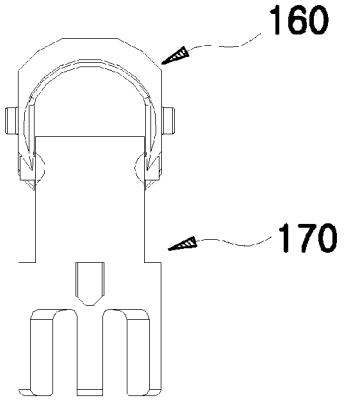
Figure 6A:
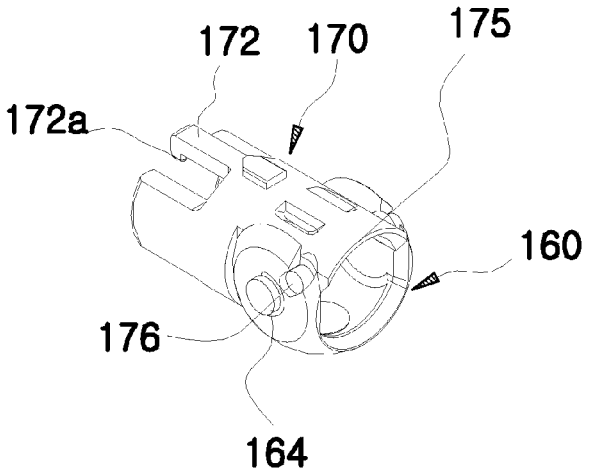
FIGS. 6A and 6B are a perspective view and a side view illustrating a state in which the ball shutter and the link are opened in the writing instrument according to the present invention.
Figure 6B:
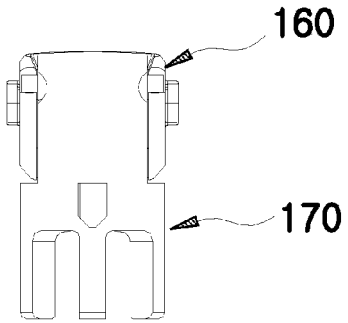
Figure 7A:
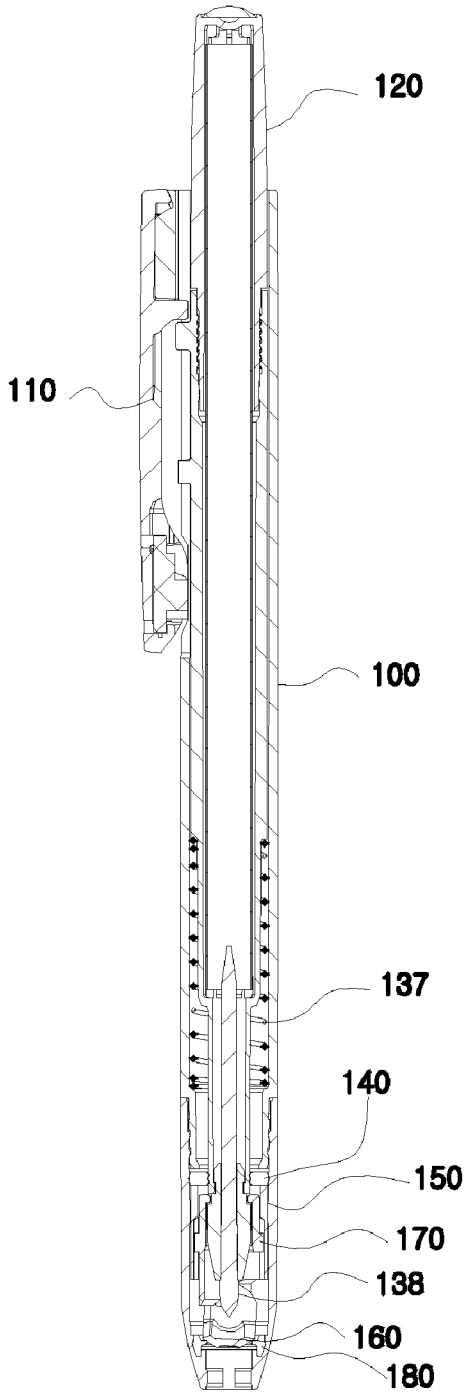
FIGS. 7A and 7B are cross-sectional views illustrating an operational relationship of the writing instrument having an automatic sealing structure according to the present invention.
Figure 7B:
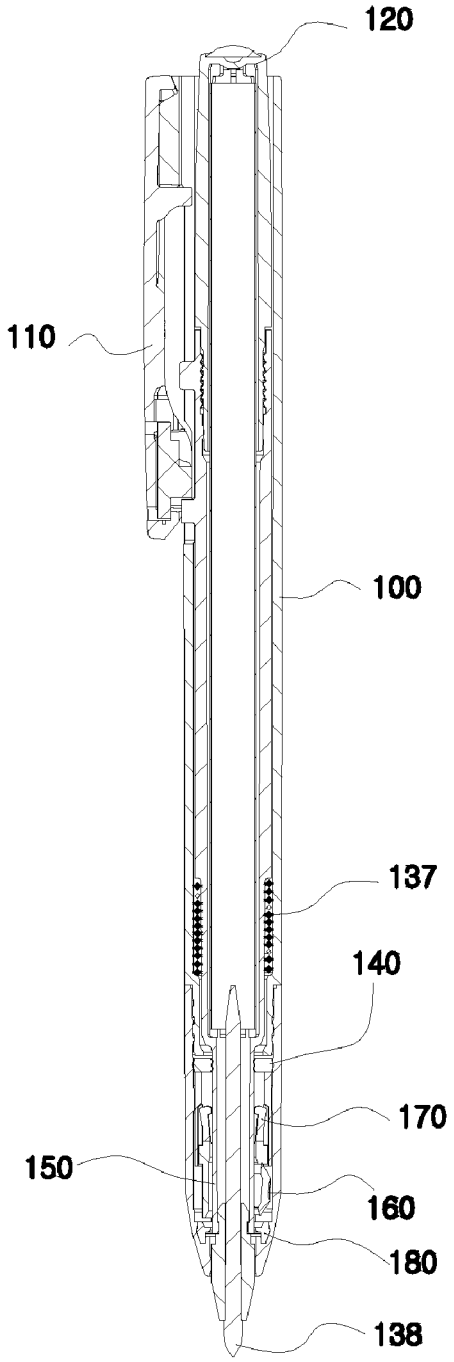

In the drawings, FIG. 3 is a perspective view illustrating a writing instrument having an automatic sealing structure according to the present invention; FIGS. 4A and 4B are perspective views illustrating a link of the writing instrument according to the present invention; FIGS. 5A and 5B are a perspective view and a side view illustrating a state in which a ball shutter and the link are closed in the writing instrument according to the present invention; FIGS. 6A and 6B are a perspective view and a side view illustrating a state in which the ball shutter and the link are opened in the writing instrument according to the present invention; and FIGS. 7A and 7B are cross-sectional views illustrating an operational relationship of the writing instrument having an automatic sealing structure according to the present invention.

As illustrated in FIG. 3, the writing instrument having an automatic sealing structure according to the present invention generally includes: a body case 100; a knock part 120 coupled to an end portion of the body case 100 so as to make a nib 138 protrude from or be retracted into the body case by a pushing operation thereof; a cartridge 130 inserted into the body case 100 together with a spring 137; first and second O-rings 140 and 180 fixedly fitted in the body case 100; a holder 150 fixedly fitted in the body case 100 so that one end thereof is covered by the O-ring 140; a ball shutter 160 pivotally coupled to the holder 150 to allow the nib 138 to protrude or be sealed according to the pivoting thereof; and a link 170 to which the ball shutter 160 is pivotally coupled.

First, the body case 100 may be made of a synthetic resin material or a metallic material using an injection molding or a mold forming method, and may have a hollow pipe or tube shape.

Such a body case 100 includes two cases which are coupled with each other by fastening with a screw or tight fitting, wherein one case of a cone shape has a front opening 102 formed at one end thereof, and the other case has a rear opening 104 having an inner diameter size, into which components to be described below including the knock part 120 can be inserted and housed.

In addition, a clip part 110 may be installed on a circumferential surface of the body case at a position adjacent to the rear opening 104, which is coupled thereto for allowing a natural clipping or releasing operation thereof as a clip means therein.

The knock part 120, which is inserted into the rear opening 104 of the body case 100 so as to make the nib 138 protrude from or be retracted into the front opening 102 of the body case 100 by a pushing operation, may be positioned and installed inside of the rear opening 104 so as to transfer a force to the cartridge 130 by the pushing operation of a user, and has a tube shape having a small diameter circumferential surface and a large diameter circumferential surface formed in a layered structure. Herein, one end of the small diameter circumferential surface is opened and the other end of the large diameter circumferential surface is closed.

In addition, the cartridge 130 corresponds to an ink storage portion, and may have an internal volume of a predetermined capacity.

Such a cartridge 130 has a tank part 132 having a largest diameter, a connection part 133 having a relatively smaller diameter than the tank part 132, and a nib extension shaft part 134 having a relatively smaller diameter than the connection part 133, which are integrally formed therewith in such a manner that the diameters thereof are sequentially decreased toward the nib 138 from a cartridge hole 131 of the cartridge 130 while forming layers.

Further, the nib 138 is coupled to an end of the nib extension shaft part 134 through a nib fixing part 135, so that any content (for example, ink) etc. stored in the tank part 132 may be supplied thereto by a common ink supply method (for example, a capillary phenomenon, pressure difference, suction, etc.) from the tank part 132 according to a common supply method corresponding to types of the writing instrument.

Herein, the nib fixing part 135 has a stepped portion 135*a* formed at an end thereof, so as to be coupled with the nib extension shaft part 134 with a stepped space formed therein during the coupling thereof.

Meanwhile, the spring 137 as illustrated in FIG. 3 is inserted on the nib extension shaft part 134, and then is placed on a stepped face of the connection part 133 near the tank part 132 so as to be supported thereby.

Thereafter, the spring 137 plays a role of pressing the cartridge 130 in an axial direction within a stroke distance of the cartridge 130 during the operation.

For example, when the cartridge 130 and the knock part 120 move in a forward direction by a predetermined stroke distance, the spring 137 is compressed while elastic energy is restored therein, which will act as an elastic restoring force when the spring returns from the compressed to an extended state. Herein, the predetermined stroke distance of the cartridge 130 is equal to the stroke distance of the knock part 120 or to a distance between an original position and a position where the nib 138 protrudes therefrom. In addition, when the cartridge 130 and the knock part 120 are in the released state in which they can return in a backward direction, the spring 137 plays a role of returning the components coupled to the cartridge 130 including the knock part 120 to the original position by the elastic restoring force thereof.

Further, the spring 137 plays a role of attenuating a momentary impact to be applied to any one of the O-ring 140, the holder 150, and the ball shutter 160 by the finger pushing force of the user for moving forward the cartridge 130 and the knock part 120.

In addition, the first and second O-rings 140 and 180 fixedly fitted in the body case 100 serve as a means for maintaining airtightness at the inner circumference of the body case 100 together with the cartridge 130, and are made of any one material of rubber, silicon, and soft plastic, which are commonly used as a watertight means and/or an airtight means.

The holder 150, the ball shutter 160, and the link 170 may be located between the first O-ring 140 and the second O-ring 180.

In addition, the holder 150, which is fixedly fitted in the body case 100 so that one end thereof is covered by the first O-ring 140, is supported by the first O-ring 140, thus to play a role of closely contacting the ball shutter 160 to a hemispherical face inside of the front opening 102 in the body case 100.

The holder 150 has a pair of hinge parts 152 which correspond to a hollow bushing and are formed on a front portion thereof in a semicircular shape to face each other. When the ball shutter 160 is coupled to the hinge parts 152, these hinge parts play a role of provide a stable support surface while allowing the ball shutter 160 to be pivoted.

In addition, it is preferable that the holder 150 has a rear portion having a diameter corresponding to the diameter of the first O-ring 140, and a locking groove 154 is formed therein on both sides at a predetermined length in a direction perpendicular to the hinge parts 152, thereby providing a guide line for a guide key 178 formed on the link 170 and defining a clearance space for elastic lugs 172, which will be described below.

The ball shutter 160 is pivotally coupled to the holder 150 to function as a door for allowing the nib to be moved forward or sealed according to the pivoting thereof. The ball shutter 160 has a through passage 162 formed therein in a substantially circular shape, which is open while passing through an axial center on both outer peripheral sides of the circular-shaped spherical face, and hinge shafts 164 formed on both sides thereof at outer central portions orthogonal to the through passage 162.

Further, the ball shutter 160 has pin slits 166 formed to face each other at eccentric positions near the hinge shafts 164, which may be slantly formed toward the central portion. The pin slits 166 are provided at positions corresponding to pins 176 of the link 170 to be inserted therein, which will be described below, and the pin slits 166 inclined at the eccentric positions may be engaged with the pins 176, so as to play a role similar to a cam groove for converting a force generated by the forward movement of the link 170 to a force that pivots the ball shutter 160 within a rotational angle range of a limited magnitude.

Meanwhile, the link 170, which is slidably fitted in the holder 150, is provided for inserting the nib extension shaft part 134, as illustrated in FIGS. 4A and 4B, 5A and 5B and FIGS. 6A and 6B, and includes a pair of elastic lugs 172 formed at one end portion thereof facing the holder 150, which are cut and face each other with only one end being opened in the axial direction while maintaining a predetermined angle interval in a circumferential direction.

The link 170 may have hook-shaped locking parts 172*a* disposed at a rear portion thereof and formed on tips of the respective elastic lugs 172, and a pair of normally locked protrusions 174 formed to face each other on a hollow column inner surface thereof in a direction orthogonal to the locking parts 172*a*.

The locking parts 172*a* of the elastic lugs 172 and the normally locked protrusions 174 are positioned on the above-described stepped portion 135*a* of the nib fixing part 135. When the cartridge 130 moves forward, the elastic lug 172 is enlarged from the tube locking groove 154 of the holder 150 together with the locking part 172*a*, thus to facilitate the cartridge 130 to move forward.

Further, the link 170 may have a cutaway piece 175 which is integrally formed therewith and extends in the axial direction from the elastic lug 172.

The cutaway piece 175 is formed by protruding a circumferential portion of a part of the hollow column end of the link 170 to allow the ball shutter 160 to be pivoted.

The cutaway piece 175 may have cutaway faces 175*a* formed on both sides thereof in the longitudinal direction, and pins 176 formed on the cutaway faces 175*a* at positions corresponding to the pin slits 166 of the ball shutter 160 for coupling therewith. Further, the link 170 may have a cutaway jaw 177 formed along the circumferential surface thereof on the other side of the column orthogonal to the cutaway faces 175*a* to limit the pivoting of the ball shutter 160.

Further, the cutaway piece 175 may be formed so as to have a circumferential length equal to or smaller than an inner circumferential length of the ball shutter 160.

Furthermore, the cutting jaw 177 may have a circumferential diameter of the same as an outer circumferential diameter of the ball shutter 160.

Meanwhile, the link 170 has the guide key 178 similar to a home plate shape found in baseball formed on the columnar surface between the elastic lug 172 and the cutaway piece 175, which is preferably formed on the same line on which the elastic lug 172 is formed.

As described above, the guide key 178 can move along the locking groove 154 of the holder 150.

FIGS. 7A and 7B are cross-sectional views illustrating an operational relationship of the writing instrument having an automatic sealing structure according to the present invention. Hereinafter, nib protruding and retracting operations of the writing instrument having an automatic sealing structure according to the present invention having the above-described configuration will be described with reference to these drawings.

When assembling the writing instrument, the cartridge 130 is positioned inside of the body case 100, and the knock part 120 is fastened to one end of the cartridge 130 in a coupling method such as tight fitting or fastening with a screw.

In such a state, FIG. 7A shows a state in which the front opening 102 is closed by the ball shutter 160 at a start position of an initial stroke.

That is, the through passage 162 of the ball shutter 160 is directed in a direction perpendicular to the axial direction of the cartridge 130.

In addition, since the first O-ring 140 maintains airtightness between the holder 150 and the spring 137, and the ball shutter 160 is also in close contact with the front opening 102, consequently, the inner space of the body case 100 between the front opening 102 and the second O-ring 180 becomes in a sealed state, such that the ink in the nib 138 is prevented from drying out.

Meanwhile, the nib 138 is installed therein with being surrounded by the nib fixing part 135, and in particular, the locking parts 172*a* and the normally locked protrusions 174 of the link 170 are engaged with the stepped portion 135*a*.

In addition, the link 170 is inserted into the holder 150, and the spring 137 installed between the first O-ring 140 and the connection part 133 of the cartridge 130 applies a force pressing in a direction opposite to each other between the body case 100 connected to the link and the first O-ring 140 by the elastic restoring force thereof.

Further, as illustrated in FIG. 7B, in order to perform the nib protruding operation, when the knock part 120 is pushed down to a very small stroke distance by a switch fixing operation or pushing operation of the knock part by the user, the knock part 120 and the cartridge 130 move forward as much as the stroke distance in the forward direction.

At this time, although the spring 137 is in the same state as described above, it applies a slightly increased spring elastic restoring force corresponding to the movement ratio to the cartridge 130, such that with the holder 150 being fixed, the cartridge 130 and the link 170 coupled thereto move as much as the stroke distance.

Herein, when the knock part 120 is further pushed down by the user as much as the predetermined stroke distance, the pin 176 of the moving forward link 170 slides along the inclined pin slit 166 of the ball shutter 160, such that the ball shutter 160 is rotated by 90 degrees by the hinge shaft 164 inserted into the hinge part 152 of the holder 150, and the guide key 178 of the link 170 moves along the locking groove 154 of the fixed holder 150.

At this time, since the cutaway piece 175 of the link 170 has a length of an arc that does not overlap with the inside of the ball shutter 160, the ball shutter 160 is pivoted along the cutaway faces 175*a* which are rotated by about 90 degrees, and thereby being pivoted to the position of the cutaway jaw 177.

Herein, since the cutaway piece 175 is formed so as to have a circumferential length equal to or smaller than the inner circumferential diameter of the ball shutter 160, the ball shutter 160 can be formed on the same surface as the link 170 without protruding therefrom.

Accordingly, the through passage 162 of the ball shutter 160 coincides with the cartridge 130 in the axial direction thereof to communicate with the front opening 102.

The nib 138 protrudes from the front opening 102 and is maintained in the protruding state. In this state, the user can use the writing implement of the present invention.

Meanwhile, when the user performs the nib retracting operation by releasing the clip part 110, the nib 138 in the protruded state may return to the original position inside of the body case 100.

For this, the user pushes down the knock part 120 to move the clip part 110 backward in a direction in which the clip part 110 is released from the stepped groove 105 of the body case 100.

Thereby, the compressed spring 137 is extended to move the knock part 120 and the cartridge 130 backward, and the nib retracting operation is performed in an order reverse to the nib protruding operation.

That is, the moving backward cartridge 130 is inserted into the link 170, and as described above, the elastic lug 172 of the link 170 moves along the locking groove 154.

With the backward movement of the link 170, the pin 176 of the link 170 allows the ball shutter 160 to be pivoted as much as a pivot angle of about 90 degrees to return it to the original position.

When the spring 137 is extended to its original length, the knock part 120, the cartridge 130, the nib 138, and the link 170 return to the start position of the initial stroke, and then the front opening 102 is closed by the ball shutter 160, such that the nib 138 is securely and airtightly housed in the through passage 162 of the ball shutter 160.

As described above, according to the present invention, it is possible to achieve miniaturization in which an entire diameter of the writing instrument may be reduced due to a decrease in the size of the ball shutter, thus to improve a grip feeling of the user. Further, since the diameter of the body case 100 of the writing instrument is significantly reduced due to a decrease in the size of the ball shutter 160, an amount of air inflowing each time of opening and closing the ball shutter may be relatively reduced, and consequently, more effectively preventing ink from drying out.

While the present invention has been described with reference to the preferred embodiments and modified examples, the present invention is not limited to the above-described specific embodiments and the modified examples, and it will be understood by those skilled in the related art that various modifications and variations may be made therein without departing from the scope of the present invention as defined by the appended claims, as well as these modifications and variations should not be understood separately from the technical spirit and prospect of the present invention.

DESCRIPTION OF REFERENCE NUMERALS

100: body case, 102: front opening
104: rear opening, 110: clip part
120: knock part, 130: cartridge
131: cartridge hole, 132: tank part
133: connection part, 134: nib extension shaft part
135: nib fixing part, 135*a*: stepped portion
137: spring, 138: nib
140, 180: first, second O-rings, 150: holder
152: hinge part, 154: locking groove
160: ball shutter, 162: through passage
164: hinge shaft, 166: pin slit
170: link, 172: elastic lug
172*a*: locking part, 174: normally locked protrusion
175: cutaway piece, 175*a*: cutaway face
176: pin, 177: cutaway jaw
178: guide key

What is claimed is:

1. A writing instrument having an automatic sealing structure, comprising:

a body case having a front opening formed in one end thereof;

a knock part coupled to the other end of the body case so as to make a nib protrude from or be retracted into the front opening of the body case by a pushing operation thereof;

a cartridge inserted into the body case together with a spring in a state in which the knock part and the nib are coupled to both ends thereof, respectively;

at least one O-ring fixedly fitted in the body case;

a holder fixedly fitted in the body case so that one end thereof is covered by the O-ring;

a ball shutter pivotally coupled to the holder to allow the nib to protrude or be sealed according to the pivoting thereof; and a link which is slidably fitted in the holder, and has a cutaway piece formed by protruding a circumferential portion of a part of a hollow column end thereof to allow the ball shutter to be pivoted.

2. The writing instrument having an automatic sealing structure according to claim 1, wherein the link includes:

a pair of elastic lugs formed to face each other at the hollow column end side facing the holder;

cutaway faces formed on both sides of the cutaway piece in a longitudinal direction thereof; and a cutaway jaw formed along a circumferential surface thereof on the other side of the column orthogonal to the cutaway faces to limit the pivoting of the ball shutter.

3. The writing instrument having an automatic sealing structure according to claim 1, wherein the cutaway piece is formed so as to have a circumferential length equal to or smaller than an inner circumferential length of the ball shutter.

4. The writing instrument having an automatic sealing structure according to claim 2, wherein the cutaway piece is formed so as to have a circumferential length equal to or smaller than an inner circumferential length of the ball shutter.

5. The writing instrument having an automatic sealing structure according to claim 2, wherein the cutting jaw has a circumferential diameter of the same as an outer circumferential diameter of the ball shutter.

* * * * *